US005454403A

United States Patent [19]

Kerr et al.

[11] Patent Number: 5,454,403

[45] Date of Patent: Oct. 3, 1995

[54] WEAVING METHOD FOR CONTINUOUS FIBER COMPOSITES

[75] Inventors: William R. Kerr, Kettering; Allan W. Gunderson, Xenia, both of Ohio

[73] Assignee: The United States of America as represented by the Secrtary of the Air Force, Washington, D.C.

[21] Appl. No.: 13,265

[22] Filed: Feb. 3, 1993

[51] Int. Cl.[6] ..... D03C 13/00; D03D 15/02

[52] U.S. Cl. ..... 139/35; 139/420 R; 139/420 A; 139/425 R; 428/259; 428/263

[58] Field of Search ..... 139/1 R, 420 R, 139/425 R, 420 A, 420 C, 420 D, 35; 428/242, 228, 257, 258, 259, 263, 284, 285, 607, 608

[56] References Cited

U.S. PATENT DOCUMENTS

| | | | |
|---|---|---|---|
| 3,417,794 | 12/1968 | Lynch | 139/420 |
| 3,871,946 | 3/1975 | Romanski et al. | 139/420 |
| 4,292,077 | 9/1981 | Blackburn et al. | 75/175 |
| 4,639,399 | 1/1987 | Aprigliano | 428/632 |
| 4,867,644 | 9/1989 | Wright et al. | 416/230 |
| 4,877,689 | 10/1989 | Onstott | 428/607 |
| 4,919,594 | 4/1990 | Wright et al. | 416/230 |
| 5,104,460 | 4/1992 | Smith, Jr. et al. | 148/11.5 F |
| 5,180,409 | 1/1993 | Fischer | 139/420 C |

*Primary Examiner*—Clifford D. Crowder
*Assistant Examiner*—Larry D. Worrell, Jr.
*Attorney, Agent, or Firm*—Bobby D. Scearce; Thomas L. Kundert

[57] ABSTRACT

A method for fabricating a fiber-metal matrix composite is described, which comprises the steps of providing fiber and metal crossweave strands, interweaving the fiber and crossweave strands by tightly crimping the strands in sets of at least two spaced about one fiber diameter apart around the fibers and spacing the strand sets about 35 to 50 fiber diameters apart, and subsequently consolidating the weave by hot pressing.

6 Claims, 2 Drawing Sheets

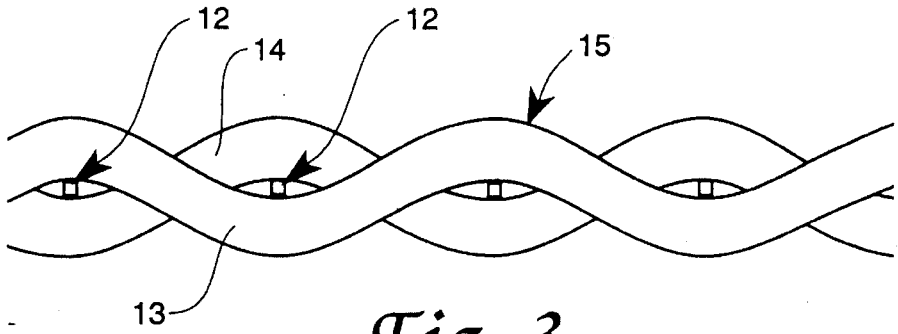
Fig. 3
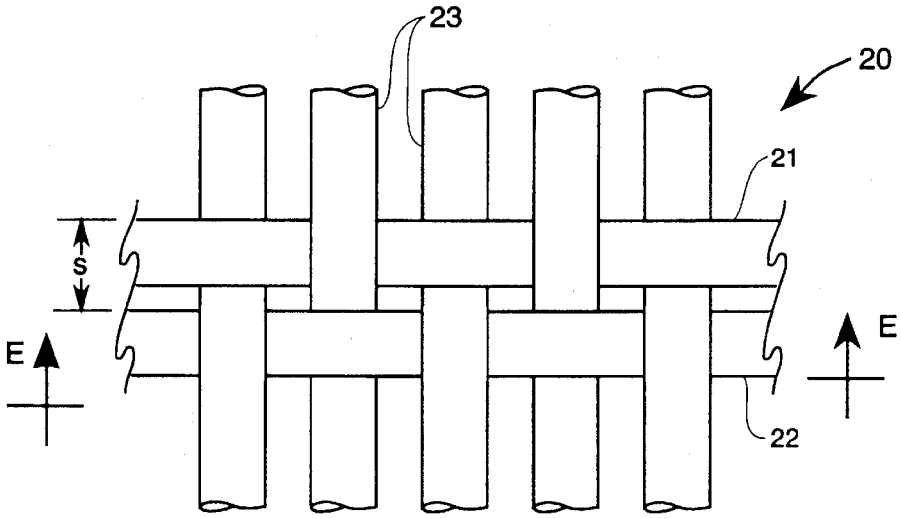
Fig. 4
Fig. 5
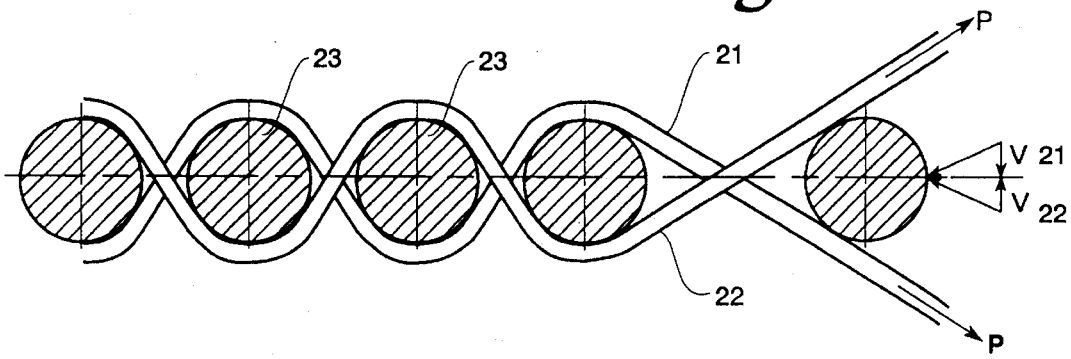

WEAVING METHOD FOR CONTINUOUS FIBER COMPOSITES

RIGHTS OF THE GOVERNMENT

The invention described herein may be manufactured and used by or for the Government of the United States for all governmental purposes without the payment of any royalty.

BACKGROUND OF THE INVENTION

The present invention relates generally to methods for fabricating fiber-metal matrix composites and more particularly to an improved method for laying up fiber and metal matrix material for improved structural strength in the composite.

Conventional continuous fiber metal matrix composites may be produced in alternate layers of ceramic fiber mats and metal foil which are encapsulated, outgassed and consolidated by hot pressing. In order to hold the fibers in place during processing, fiber mats are produced by interweaving strands of metallic crossweave material, usually wire (typically about 2 mils dia) or ribbon (typically 5–10 mils wide by ½–2 mils thick), in a box weave pattern of alternate fibers (typically 4–6 mils dia) and crossweave strands, the crossweave strands typically being spaced apart about 18 to 35 fiber diameters. However, because of the tension in the crossweave strands, such as might be imposed on the strands incident to the weaving process, the fibers are displaced out of the plane of the centerline of the fabric and are bent into wave-like patterns of undulations over and under the crossweave strands, the undulations lying in planes perpendicular to the centerline plane of the fabric. When the fiber mat is pressed between foil during processing, the fibers rotate and buckle and may break the crossweave strands and tend to slide along the crossweave strands so that large arcs are formed defining defect areas in the ply which are devoid of fibers and wherein the fibers are not parallel to the design lead axis.

The invention solves or substantially reduces in critical importance problems with conventional composite fabrication methods by providing an improved method for laying up the composite which eliminates the problem of fiber bow in the mats by placing the crossweave strands close together in sets of two or more. The crossweave strands are crimped around and against each fiber, which crimping of the strands holds each fiber tightly in place and prevents the fibers from slipping along the crossweave. As a result, the fibers lie flat in or very near the plane of the centerline of the mat. Geometrical instability and defects resulting from fiber bowing in the finished composite are substantially eliminated.

It is therefore a principal object of the invention to provide a method for fabricating fiber-metal matrix composites.

It is a further object of the invention to provide a method for fabricating a fiber-metal matrix composite having enhanced strength.

It is yet another object of the invention to provide a method for fabricating a fiber-metal matrix composite free of certain defects.

These and other objects of the invention will become apparent as a detailed description of representative embodiments proceeds.

SUMMARY OF THE INVENTION

In accordance with the foregoing principles and objects of the invention, a method for fabricating a fiber-metal matrix composite is described, which comprises the steps of providing fiber and metal crossweave strands, interweaving the fiber and crossweave strands by tightly crimping the strands in sets of at least two spaced about one fiber diameter apart around the fibers and spacing the strand sets about 35 to 50 fiber diameters apart, and subsequently consolidating the weave by hot pressing.

DESCRIPTION OF THE DRAWINGS

The invention will be more clearly understood from the following detailed description of representative embodiments thereof read in conjunction with the accompanying drawings wherein:

FIG. 3 is a schematic side view of two adjacent fibers in the FIG. 1 mat with the vertical scale exaggerated to illustrate fiber bowing around crossweave strands;

FIG. 4 is a plan view of a fiber mat according to the invention with improved weaving pattern and closely spaced and crimped crossweave strands; and FIG. 5 is sectional view of the FIG. 4 fiber mat taken along line 5—5.

DETAILED DESCRIPTION

Figure 1:
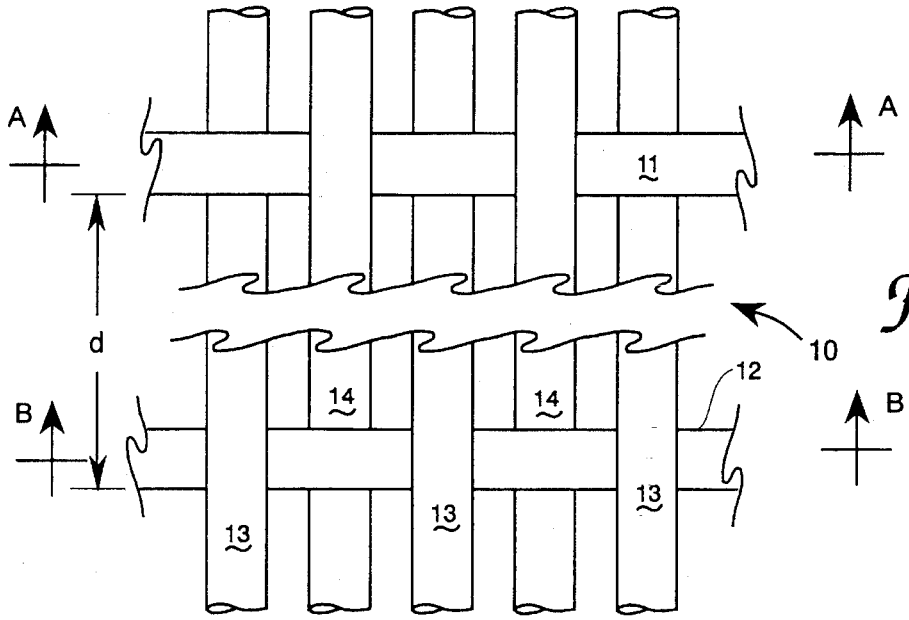
FIG. 1 is a plan view of a composite mat having crossweave strands and fibers in a box weave pattern with conventional configuration and spacing.
Figure 2B:
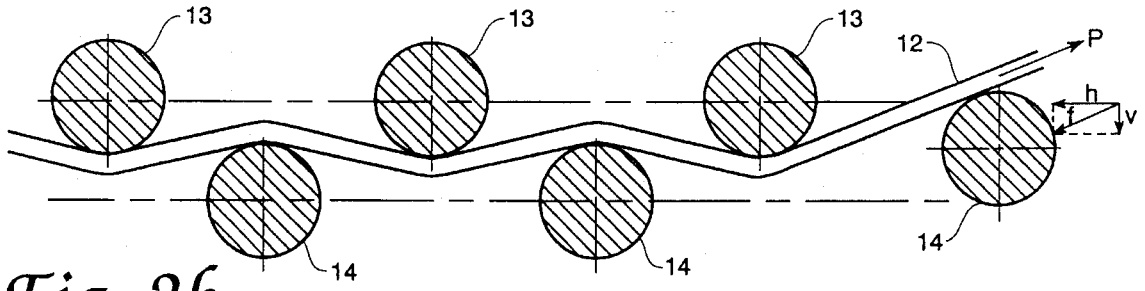
FIGS. 2*a* and 2*b* are sectional views of the FIG. 1 mat taken along lines 2*a*—2*a* and 2*b*—2*b*, respectively.
Figure 2A:
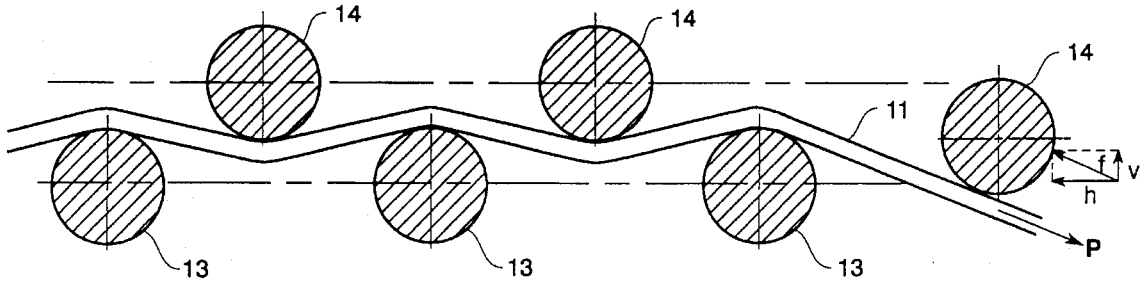

Referring now to FIG. 1, shown therein is a plan view of fiber mat 10 showing metal crossweave strands (wires or ribbons) 11,12 and fibers 13,14 in a conventional box weave pattern with conventional spacing d in which alternate strands 11,12 pass over and under alternate fibers 13,14. FIGS. 2*a* and 2*b* are, respectively, views taken along lines 2*a*—2*a* and 2*b*—2*b* of FIG. 1. In composite structures contemplated herein, strands 11,12 and fibers 13,14 may generally comprise any materials generally selected for the conventional structure, as would occur to the skilled artisan guided by these teachings, including molybdenum wire or titanium alloy wire or ribbon for strands 11,12 and silicon carbide or alumina for fibers 13,14. Crossweave strands 11,12 function to hold fibers 13,14 in place until completion of consolidation of foil (matrix) material with the fibers by hot pressing. The matrix material (e.g. foil) with which mat 10 may be consolidated by hot pressing may be selected by the skilled artisan practicing the invention and is therefore not limiting hereof. Examples of suitable materials usable as matrix include titanium alloys such as Ti—6Al—4V, Ti—15V—3Al—3Sn—3Cr, Ti—14Al—21Nb, Ti—11Al—40Nb, Ti—6Al—4V—2Zr—2Sn and Ti—15Mo—2.7Nb—3Al (β—21S). Strands 11,12 therefore ideally comprise the same material as the matrix material. Fibers 13,14 generally have high elastic modulus, but are slender and easily bowed around strands 11,12 which generally are held in tension in the weaving process and therefore are not easily bowed. Reference is now made to FIGS. 2*a*,2*b*. Because strands 11,12 are held in tension, any force f applied to fibers 13,14, such as may be experienced in the weaving process for mat 10, results in a vertical component v of force acting on alternate fibers 13,14 directed alternately upwardly (fiber 14, FIG. 2*a*) and downwardly (fiber 13, FIG. 2*b*). As a result, and as suggested in FIGS. 2*a*,2*b*, fibers 13,14 do not lie in the plane of the centerline of mat 10. Extent of the deflection is proportional to the third power of the crossweave spacing. For example, for a fiber 13,14 having an elastic modulus of $6\times10^7$ psi and a crossweave spacing of 35 fiber diameters, a vertical force component v of only 0.07 lbs is required to produce deflections of magnitude suggested in FIGS. 2*a*,2*b*. Because of this deflection fibers 13,14 in mat 10 are bowed into the wave-like shape shown schematically in FIG. 3 in which each undulation 15 lies in a plane vertical to the plane of mat 10. When pressed between foil during processing, undulations 15 rotate through 90° to horizontal, and the fibers slip along and break the crossweave, resulting in the defects described above.

FIG. 4 shows a plan view of representative fiber mat 20 according to the invention with improved weaving pattern and closely spaced crossweave strands. FIG. 5 is a view of the FIG. 4 mat taken along line 5—5. As suggested in FIG. 5, in mat 20 of the invention, adjacent crossweave strands 21,22 are placed close together in the mat in sets of two or more (2 shown in FIGS. 4,5) and preferably in sets of 2 to 3, with spacing s of about 1 or less fiber 23 diameter. The vertical components $v_{21}$,$v_{22}$ of the force acting on fibers 23 act over a very short span with no appreciable deflection of fibers 23, and the vertical components of force $v_{21}$,$v_{22}$ balance, which, as a comparison of FIG. 5 with FIGS. 2*a*,2*b* shows, result in a substantially flat mat with no bow of the fibers. In accomplishing the configuration shown in FIG. 5, the weaving process for mat 20 crimps crossweave strands 21,22 tightly against each fiber 23 because the vertical components of the force pushing each fiber 23 into the mat are balanced; each fiber 23 crimps crossweave strands 21,22 against the adjacent fiber 23 which prevents each fiber from slipping in the assembled mat 20. Assembly of the improved mat 20 of the invention may be accomplished on existing looms by the skilled artisan practicing the invention. In accordance with conventional procedures, assembled woven mats of the invention may be layered with matrix material and consolidated to a finished composite by hot pressing or other process known in the applicable art.

The invention therefore provides an improved method for fabricating a fiber-metal matrix composite. It is understood that modifications to the invention may be made as might occur to one with skill in the field of the invention within the scope of the appended claims. All embodiments contemplated hereunder which achieve the objects of the invention have therefore not been shown in complete detail. Other embodiments may be developed without departing from the spirit of the invention or from the scope of the appended claims.

I claim:

1. A method for fabricating a fiber-metal matrix composite comprising the steps of:

(a) providing a source of ceramic fibers and a source of metallic strands;

(b) interweaving said metallic strands and said ceramic fibers to form a woven mat and tightly crimping said metallic strands in sets of at least two against said fibers in said mat;

(c) spacing said metallic strands in each set apart a distance equal to about one diameter of said ceramic fibers;

(d) spacing said sets apart a distance equal to about 35 to 50 diameters of said ceramic fibers; and (e) consolidating said woven mat by hot pressing.

2. The method of claim 1 wherein said source of ceramic fibers comprises a material selected from the group consisting of silicon carbide and alumina, and said source of metallic strands comprises a material selected from the group consisting of molybdenum and a titanium alloy.

3. A method for fabricating a fiber-metal matrix composite comprising the steps of:

(a) providing a source of ceramic fibers and a source of metallic strands;

(b) interweaving said metallic strands and said ceramic fibers to form a woven mat and tightly crimping said metallic strands in sets of at least two against said fibers in said mat;

(c) spacing said metallic strands in each set apart a distance equal to about one diameter of said ceramic fibers;

(d) spacing said sets apart a distance equal to about 35 to 50 diameters of said ceramic fibers;

(e) providing a source of metallic matrix material; and (f) consolidating said woven mat and said metallic matrix material by hot pressing.

4. The method of claim 3 wherein said source of ceramic fibers comprises a material selected from the group consisting of silicon carbide and alumina, and said source of metallic strands comprises a material selected from the group consisting of molybdenum and a titanium alloy.

5. The method of claim 3 wherein said source of metallic matrix material comprises a material selected from the group consisting of molybdenum and a titanium alloy.

6. The method of claim 3 wherein said source of metallic strands and said source of metallic matrix material comprise the same material.

* * * * *